US010634463B1

(12) United States Patent
DeAngeles

(10) Patent No.: US 10,634,463 B1
(45) Date of Patent: Apr. 28, 2020

(54) APPARATUS FOR INCAPACITATING AN ACTIVE SHOOTER

(71) Applicant: Steven DeAngeles, Chicago, IL (US)

(72) Inventor: Steven DeAngeles, Chicago, IL (US)

( * ) Notice: Subject to any disclaimer, the term of this patent is extended or adjusted under 35 U.S.C. 154(b) by 0 days.

(21) Appl. No.: 16/657,369

(22) Filed: Oct. 18, 2019

(51) Int. Cl.
*F41H 13/00* (2006.01)
*F41H 5/08* (2006.01)
*F41H 9/10* (2006.01)

(52) U.S. Cl.
CPC ..... *F41H 13/0056* (2013.01); *F41H 5/08* (2013.01); *F41H 9/10* (2013.01); *F41H 13/0081* (2013.01)

(58) Field of Classification Search
CPC ..... F41H 9/10; F41H 5/06; F41H 5/08; F41H 13/005; F41H 13/0056; F41H 13/0081; F41H 13/0087; F41H 13/00
USPC ..... 89/36.05, 36.06, 36.07, 36.01, 918, 921, 89/926
See application file for complete search history.

(56) References Cited

U.S. PATENT DOCUMENTS 4,153,927 A * 5/1979 Owens ..... B43L 3/00 362/110
5,549,220 A 8/1996 Whalen
6,367,943 B1 * 4/2002 Tocci ..... F41H 5/08 362/103
7,302,880 B1 * 12/2007 Elasic ..... F41H 5/08 89/36.01
7,980,720 B2 7/2011 Shemwell et al.
8,113,689 B2 * 2/2012 Mayo ..... F42B 12/36 102/367
8,403,106 B2 3/2013 Bostick
8,857,310 B2 * 10/2014 Raiser ..... F41H 5/08 89/36.07
9,267,764 B2 2/2016 Seabrook
9,759,529 B2 9/2017 Childs et al.
10,152,856 B2 12/2018 Fasone
2007/0125224 A1 * 6/2007 Thomas ..... F41H 13/0087 89/36.07
2007/0283477 A1 * 12/2007 Dovner ..... F41C 33/0209 2/2.5
2008/0087684 A1 * 4/2008 Koshimoto ..... B65D 83/20 222/192
2011/0235467 A1 * 9/2011 Bostick ..... A01M 29/16 367/139
2018/0128578 A1 5/2018 Huggins et al.

FOREIGN PATENT DOCUMENTS

JP 2004293845 A * 10/2004 ..... F41H 9/10
WO WO-2006078291 A1 * 7/2006 ..... F41H 5/08

* cited by examiner

*Primary Examiner* — Jonathan C Weber
(74) *Attorney, Agent, or Firm* — Lesley A. Wallerstein, LLC

(57) ABSTRACT

I disclose an apparatus for incapacitating an active shooter. The apparatus is easy enough for an untrained person to disable, but not kill, an armed assailant. Lifting the main unit out of a discreet docking station unfurls spring-loaded bullet-resistant shields and a bullet-resistant apron. This motion also releases an alarm button which automatically calls local law enforcement. Simple thumb-operated triggers unleash blinding light, deafening sound waves and a potent chemical irritant toward an attacker up to 30 yards away.

14 Claims, 12 Drawing Sheets

APPARATUS FOR INCAPACITATING AN ACTIVE SHOOTER

CROSS-REFERENCE TO RELATED APPLICATION (not applicable)

STATEMENT REGARDING FEDERALLY SPONSORED RESEARCH OR DEVELOPMENT (not applicable)

NAMES OF PARTIES TO A JOINT RESEARCH AGREEMENT (not applicable)

REFERENCE TO SEQUENCE LISTING, A TABLE OR A COMPUTER PROGRAM LISTING COMPACT DISC APPENDIX (not applicable)

FIELD OF THE INVENTION

This invention relates to an apparatus for incapacitating an active shooter or assailant.

BACKGROUND OF THE INVENTION

Thirty years ago, school and workplace shootings were few and far between. In the days before Columbine, Sandy Hook and Parkland, anyone could walk into a school. There were no metal detectors, no security desks, no transparent backpacks, no lockdown drills, no TSA. Schools were safe.

Today, we live in a country where we are allowed to buy guns. It is relatively easy to buy a gun, and very powerful ones at that. Background checks are not perfect, and frankly, you cannot protect people absolutely everywhere they go, every moment of the day.

How many of us would be able to defend ourselves if an assailant came into our home or workplace? It takes access to a weapon, knowledge how to operate it and it takes composure. There is an ongoing debate whether to arm teachers, to make that part of their professional training. How, then, is a teacher unskilled in shooting a gun supposed to disarm an assailant? There is a real need for a simple to use, effective, yet nonlethal weapon that is as easy as pressing a button.

BRIEF SUMMARY OF THE INVENTION

To solve this problem, I created an easy to use, compact and discreet apparatus for incapacitating an active shooter. A person confronted with an assailant grabs the handles of a main unit and pulls it from its docking station. This releases an alarm button on the docking station which calls local law enforcement. Spring-loaded, bullet-resistant shields and a bullet-resistant Kevlar® apron unfurl. The person aims the main unit toward the assailant and presses triggers on each handle. The apparatus emits a combination of nonlethal but high-intensity blinding light, directed sound energy and irritating chemicals toward the assailant.

The main unit is a rigid, hollow and lightweight housing having six faces, A front face of the housing has embedded therein four light sockets, means for emitting deafening sound, and a vent through which a chemical irritant can be sprayed. Each light socket has a array of laser light which emits blinding light. A rigid button projects outward from the geographic center of the front face. An opposing back face of the housing has affixed thereto a pair of handles. Each handle has a trigger that a user can press.

Each of the top face, left face and right face have rigid, bullet-resistant shields mounted thereto by springs. While the main unit is being stored, the shields rest flat against the main unit and hidden by walls of the docking station. When a person removes the main unit from the docking station, the shields spring outward, perpendicular to its corresponding face. The shields protect the user's face and chest. Attached to the edge joining the top face and the back face and draping over the back face is a Kevlar® or similar nonrigid bullet-resistant textile apron. The apron has cutouts corresponding to the handles so that it drapes flat over the back face. The apron is long enough to cover an adult user's chest, abdomen and upper thighs.

The space within the six faces comprises an aerosol canister of chemical irritant and means for propelling the irritant out the vent. This space also comprises light and sound activating means.

The docking station comprises a rigid podium about four feet tall. A top face of the docking station is countersunk the height of the main unit. When the front face of the main unit is placed against the top face of the docking station, the entire assembly forms a neat and regular prism, with the Kevlar® discreetly draping thereover. The top face of the docking station comprises two primary elements—an alarm button selectively communicating with local law enforcement—and a main unit charging port.

REFERENCE NUMERALS

Figure 1:
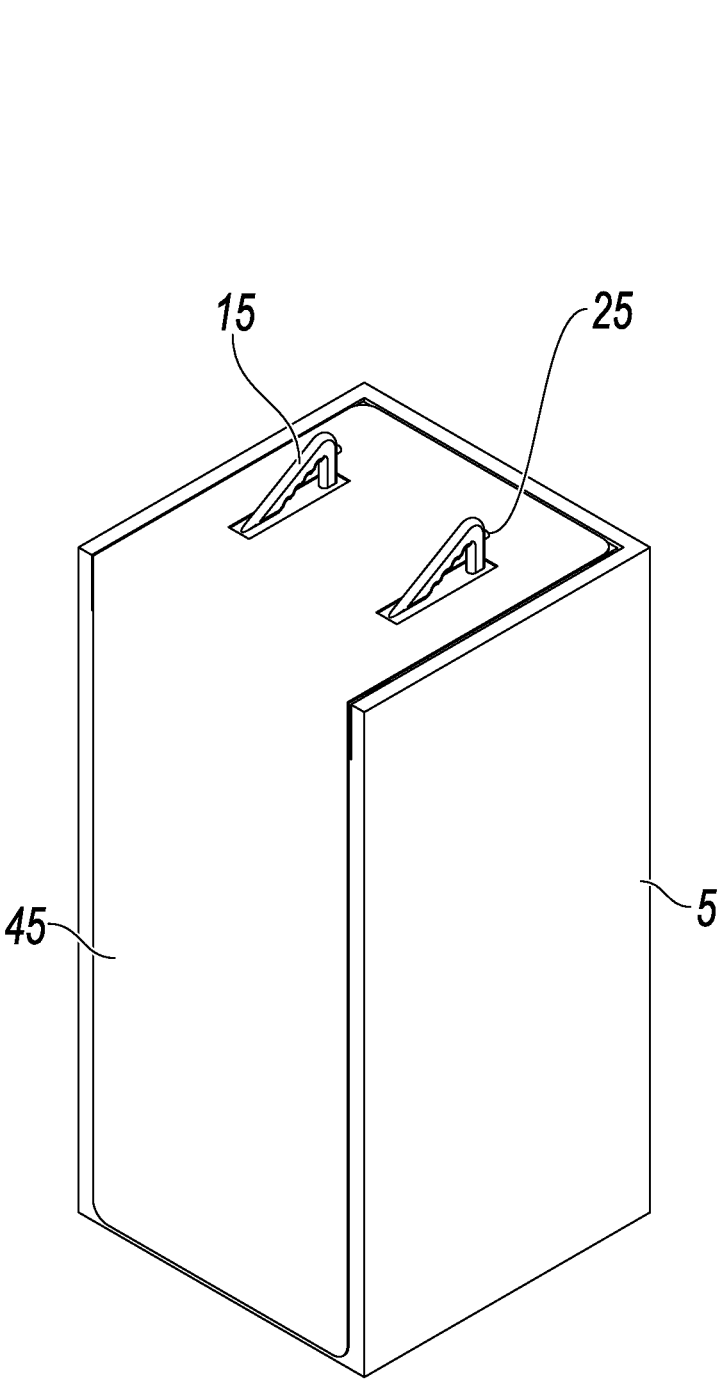
FIG. 1 is a top perspective view of an apparatus for incapacitating an active shooter, shown in a closed configuration.

1. Apparatus for incapacitating an active shooter
5. Docking station
10. Main unit
15. Handle

20. Shield
25. Trigger
30. Laser light array
35. Knob
40. Vent
45. Kevlar® apron
50. Alarm button
55. Main unit charging port
60. Spring

DETAILED DESCRIPTION OF THE INVENTION

FIG. 1 shows an apparatus for incapacitating an active shooter 1 in a storage configuration. The reader can see the external parts of the apparatus: the docking station 5, two handles 15, each handle having a trigger 25, and a Kevlar® apron 45. The main unit nests within the space created at the top of the docking station and beneath the apron and is not visible in this view. The shields are folded flat against the main unit and likewise, not visible. Also not shown is a rigid knob on the front face which projects against and compresses a corresponding alarm button on the docking station.

Apron 45 comprises a sheet of Kevlar®. Preferably the sheet of Kevlar® is a rectangle 14 inches across and three feet long, but other shapes and dimensions are possible and should be considered within the scope of this invention. A short edge of the rectangle is permanently fixed to the edge joining the top face and the back face. The apron has two holes cut out therefrom, positioned and dimensioned to fall over the handles projecting from the back face.

Figure 2:
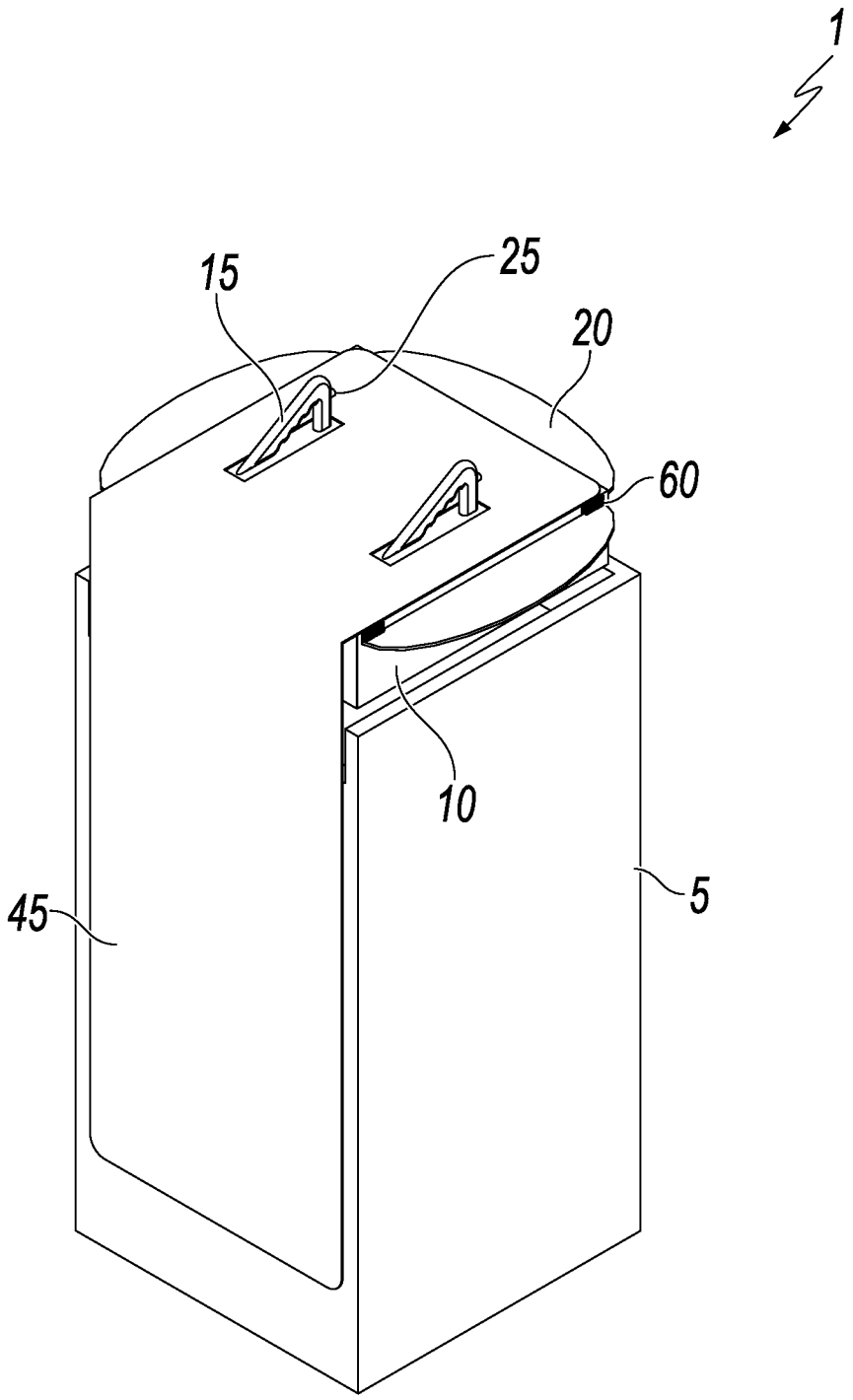
FIG. 2 is a top perspective view of the apparatus for incapacitating an active shooter of FIG. 1, shown in an open configuration.

FIG. 2 shows the main unit 10 in the process of being separated from its docking station 5. Note in particular shields 20 have sprung open perpendicular to the faces to which they are mounted. Each shield 20 is mounted to its corresponding face by a pair of spaced-apart springs 50. As the main unit is lifted from the docking station, a knob (not shown in this view) releases alarm button 50 operably connected to either local law enforcement or private sector alarm communication systems. Shields 20 are rigid, transparent, and bullet-resistant material such as aluminum, glass or plastic. Preferably, shields 20 are semi-circles 12 to 14 inch in diameter and from ½ to 1 inch thick, although, here too, other shapes and dimensions are possible and should be considered within the scope of this invention.

Figure 3:
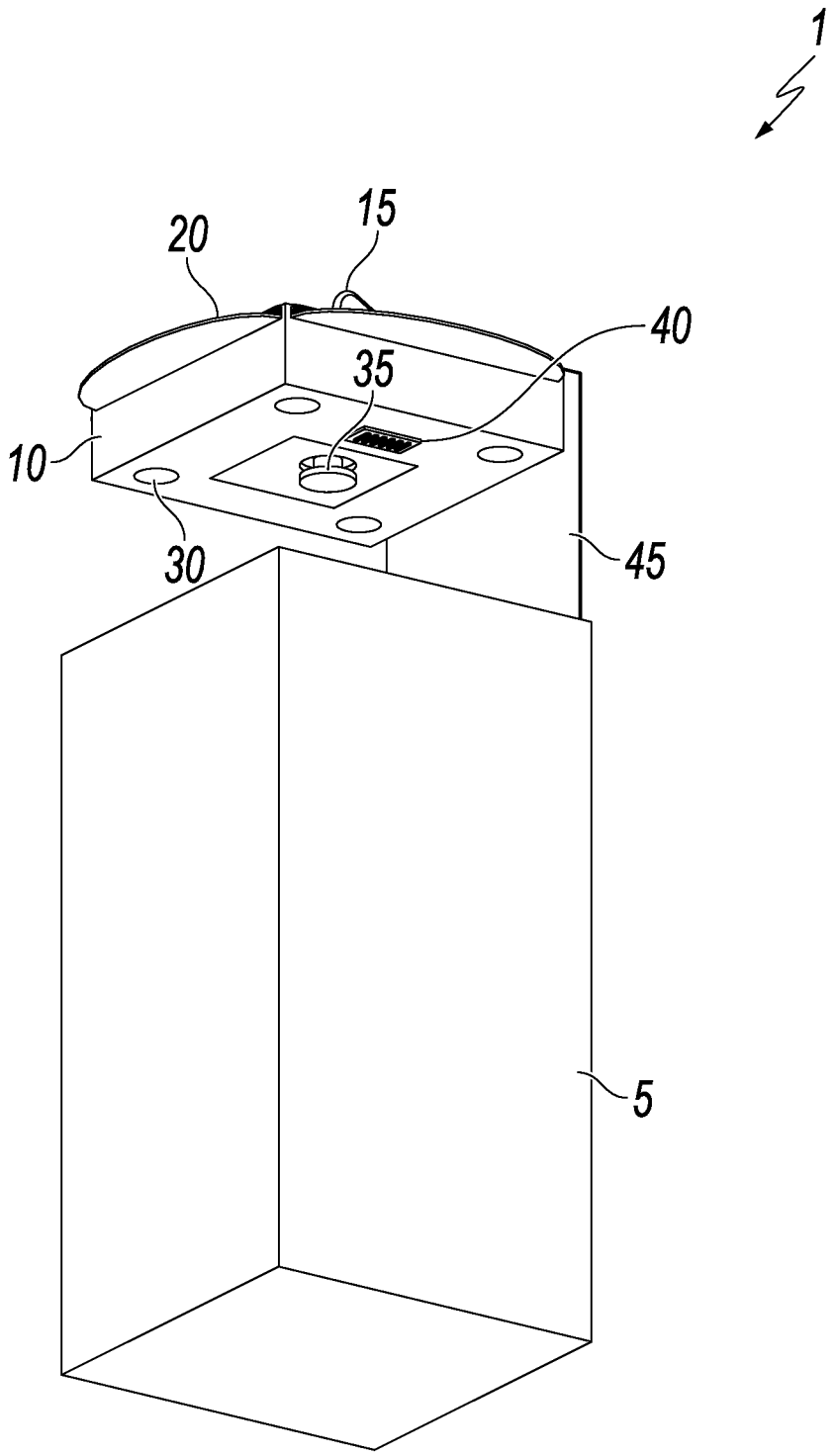
FIG. 3 is a bottom perspective view of the apparatus for incapacitating an active shooter of FIG. 1, shown in an open configuration.

FIG. 3 shows a bottom perspective view thereof, with details of the front face. Note rigid knob 35 projecting from the center of the front face, four laser light arrays 30 as well as vent 40. The vent opens to, and provides a pathway for, a canister of chemical irritant stored within the main unit. Preferably, this chemical irritant is 1-2% capsaicin. Commonly, this chemical is called "pepper spray" or "bear spray." Other capsaicinoids may be substituted or added alongside.

Preferably, the main unit is a prism. For sure, other three-dimensional hollow shapes are possible, such as a sphere or an ovoid, and should be considered within the scope of this invention. For simplicity and clarity, we illustrate a prism and describe it here. Preferably, the front face and the back face are 14-inch squares. The top face, opposing bottom face, left face and opposing right face are 4 by 14-inch rectangular panels. Each panel is ¼ inch thick. Each face of the main unit is preferably made of aluminum or steel. Other dimensions and materials known to those of ordinary skill in the art are possible and fall within the scope of this invention.

Each laser light array 30 comprises an array of high-intensity lasers producing a collective 200-1500 lumens per array. Each array of lasers sits on an oscillating base (not shown). Oscillating means such as an electric motor embedded within the main unit is operatively connected to and controls the oscillating movement of each base. In a preferred embodiment, pressing the trigger completes an electrical circuit to a motor oscillating each array of laser lights. Most preferably, the lights are oscillated to a position where the four arrays of laser lights converge on a single point in front of the user. This allows the user to aim the four laser lights to a specific part of an assailant's body, such as the eyes.

The laser light arrays may be emitted continuously, or it may be emitted in a strobe pattern. The light will be strong enough to deliver this intensity and temporarily blind a person, 30 yards away. The main unit also has means within to generate temporarily deafening and disabling directed sound energy. This directed sound energy preferably has a frequency between 3 and 25 kHz. Most preferably, the directed sound energy has a frequency between 3 and 20 kHz. The sound will preferably produce from 80-190 dB of power 30 yards away. Most preferably, the power ranges from 135-160 dB. Some of these frequencies are infrasonic or ultrasonic. That is, they are outside what the human ear can detect. These powerful sound waves resonate within a person's chest cavity, causing difficulties with breathing, cardiac rhythm, nausea and vomiting. Ear drums may rupture. As an example, 10 kHz sound waves at 80 dB will disorient and cause a person to lose balance. Sound will emanate from speakers, woofers or an array of piezoelectric transducers embedded within the main unit (not illustrated).

The right trigger 25 is electrically connected to the base of each of the laser light arrays 30 and to the sound array (not numbered). Pressing the right trigger completes a circuit which produces the light and sound. The left trigger 25 is mechanically or electrically connected to the chemical irritant. Pressing the left trigger fires the chemical irritant.

Figure 4:
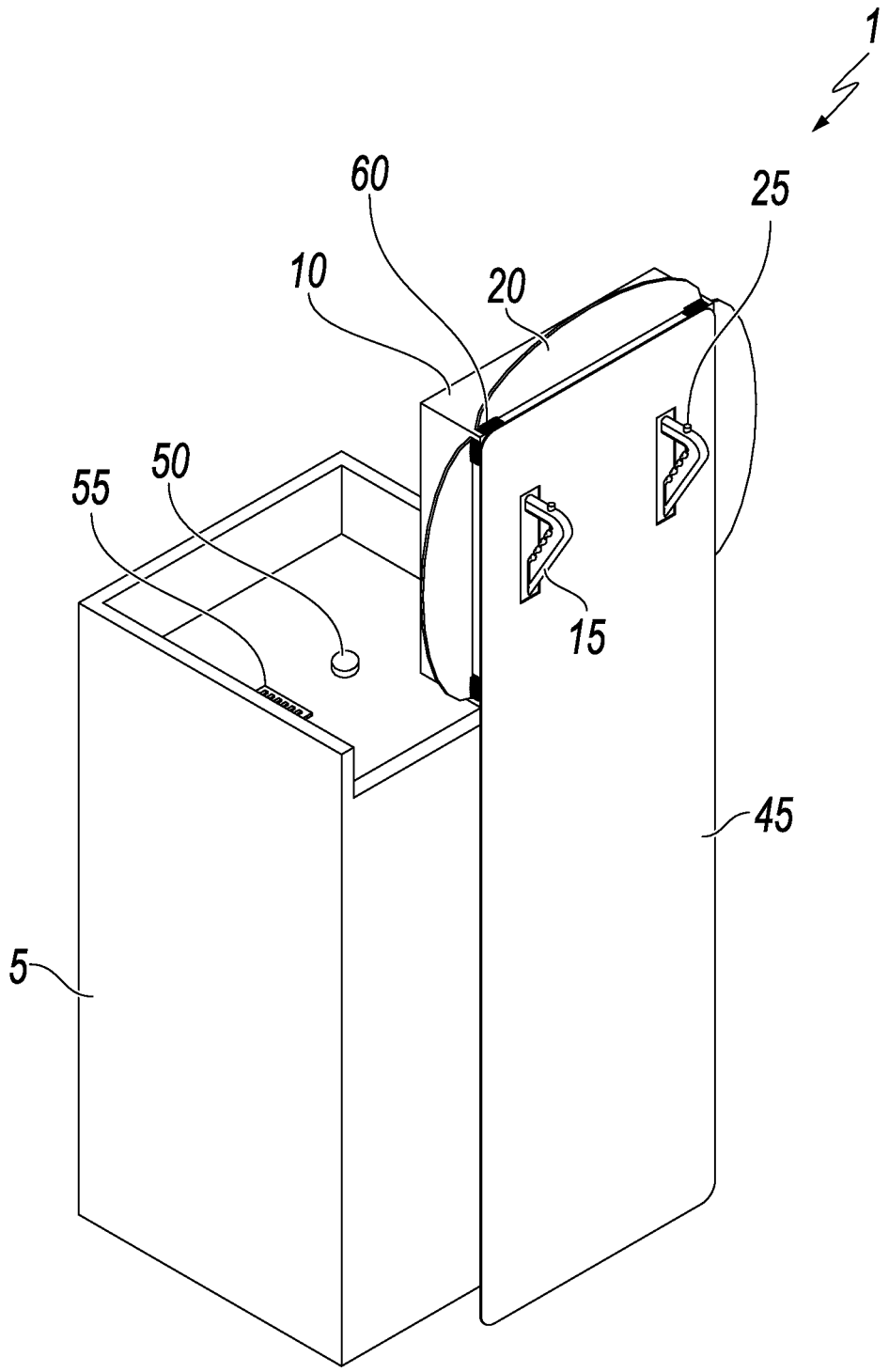
FIG. 4 is a top rear perspective view of the apparatus for incapacitating an active shooter, shown in a closed configuration.
Figure 5:
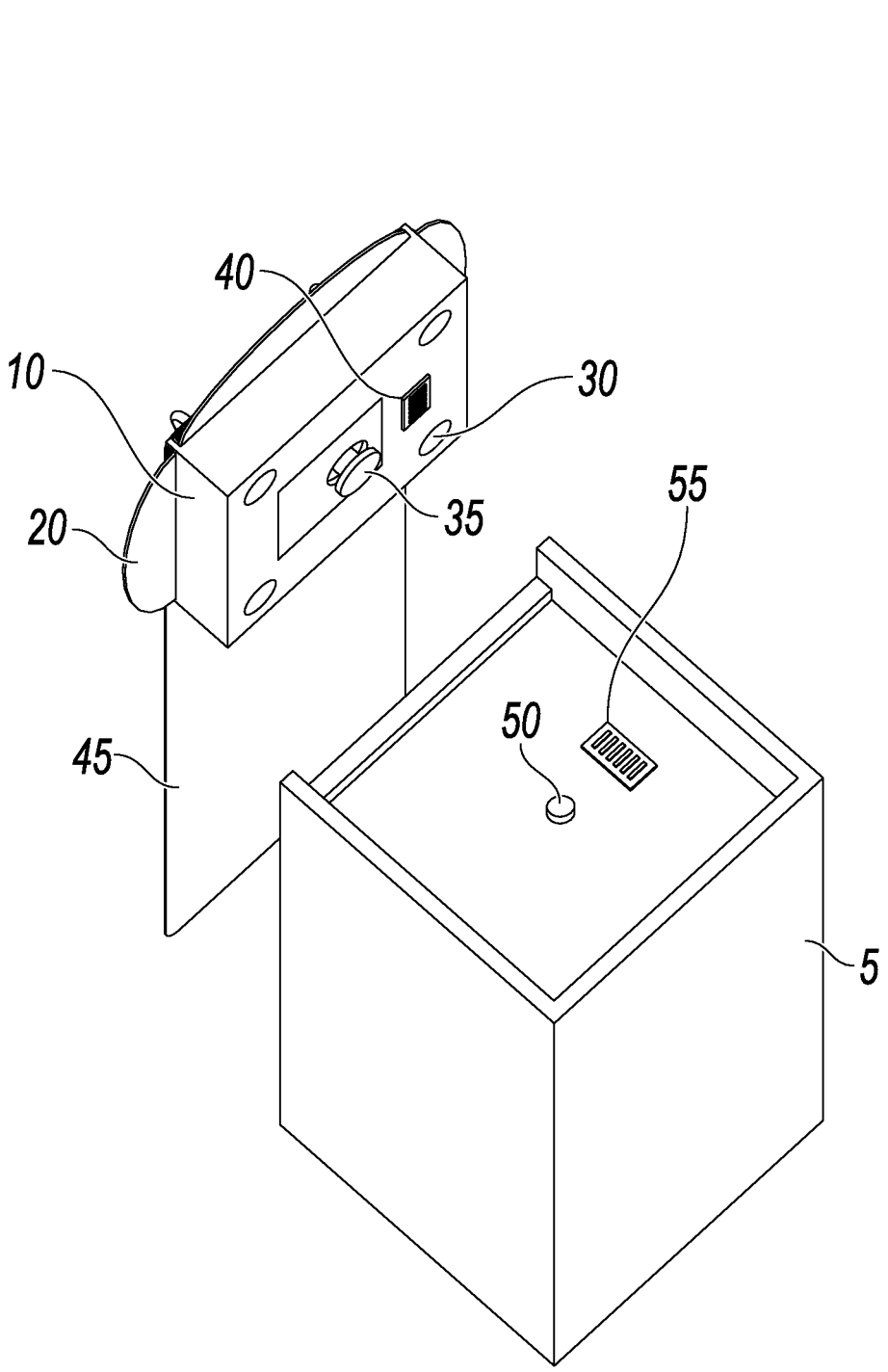
FIG. 5 is a top rear perspective view of the apparatus for incapacitating an active shooter, shown in an open configuration.
Figure 6:
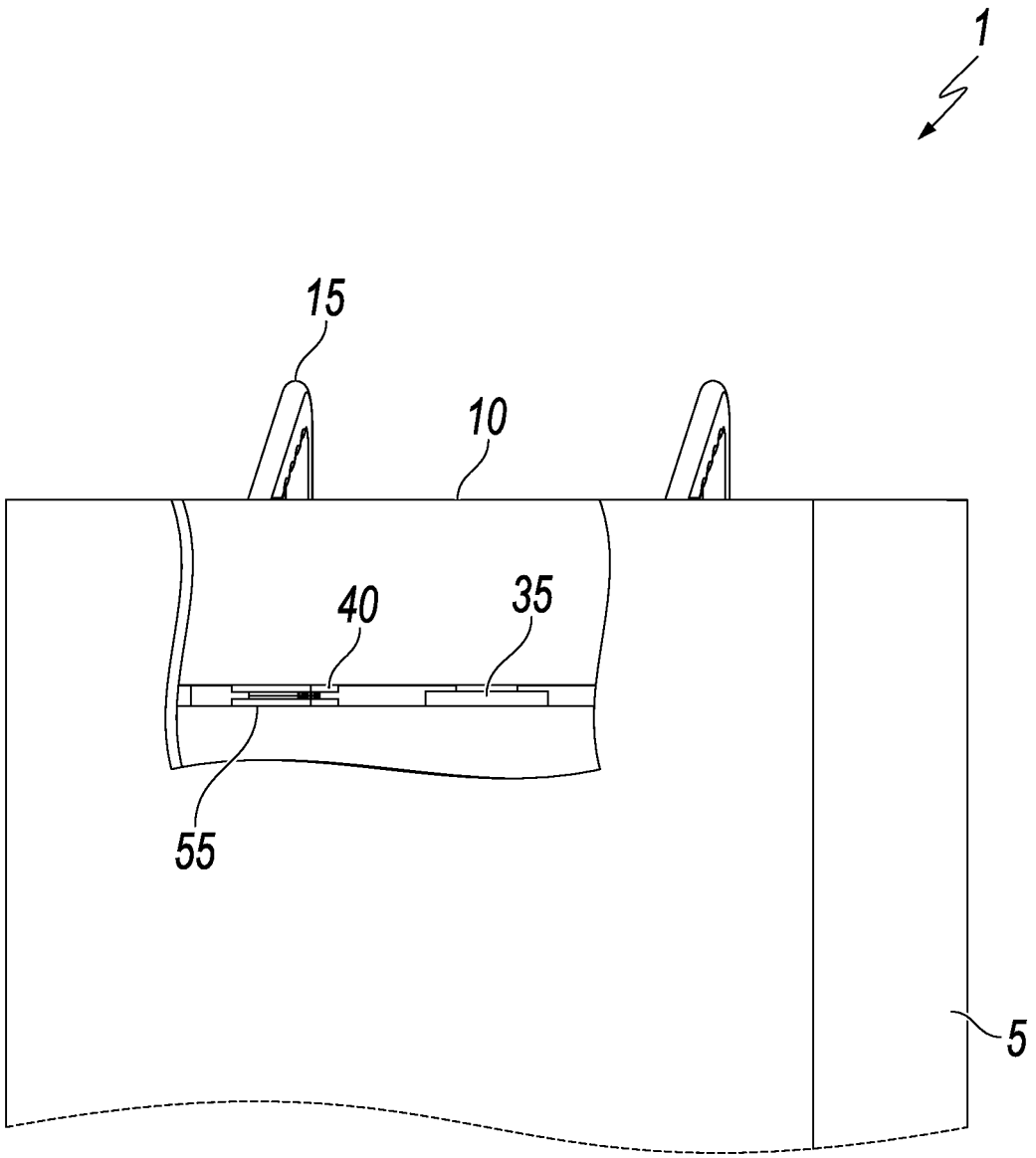
FIG. 6 is a cut-away perspective view of the apparatus for incapacitating an active shooter, shown in a person separating the plies of a top flap of apparatus for incapacitating an active shooter
Figure 7:
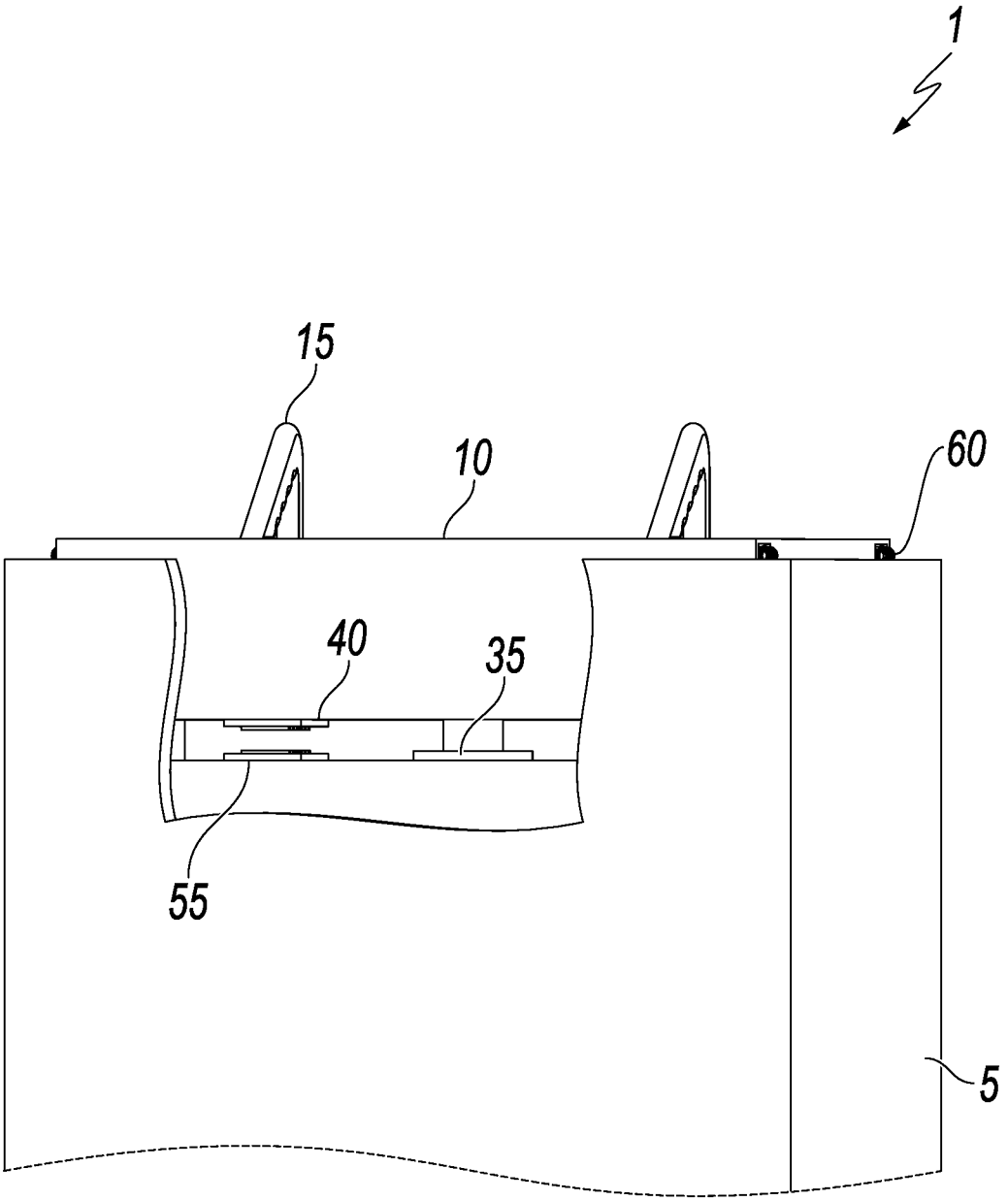
FIG. 7-10 are sequential cut-away perspective views showing the main unit being pulled progressively further away from the docking station.
Figure 8:
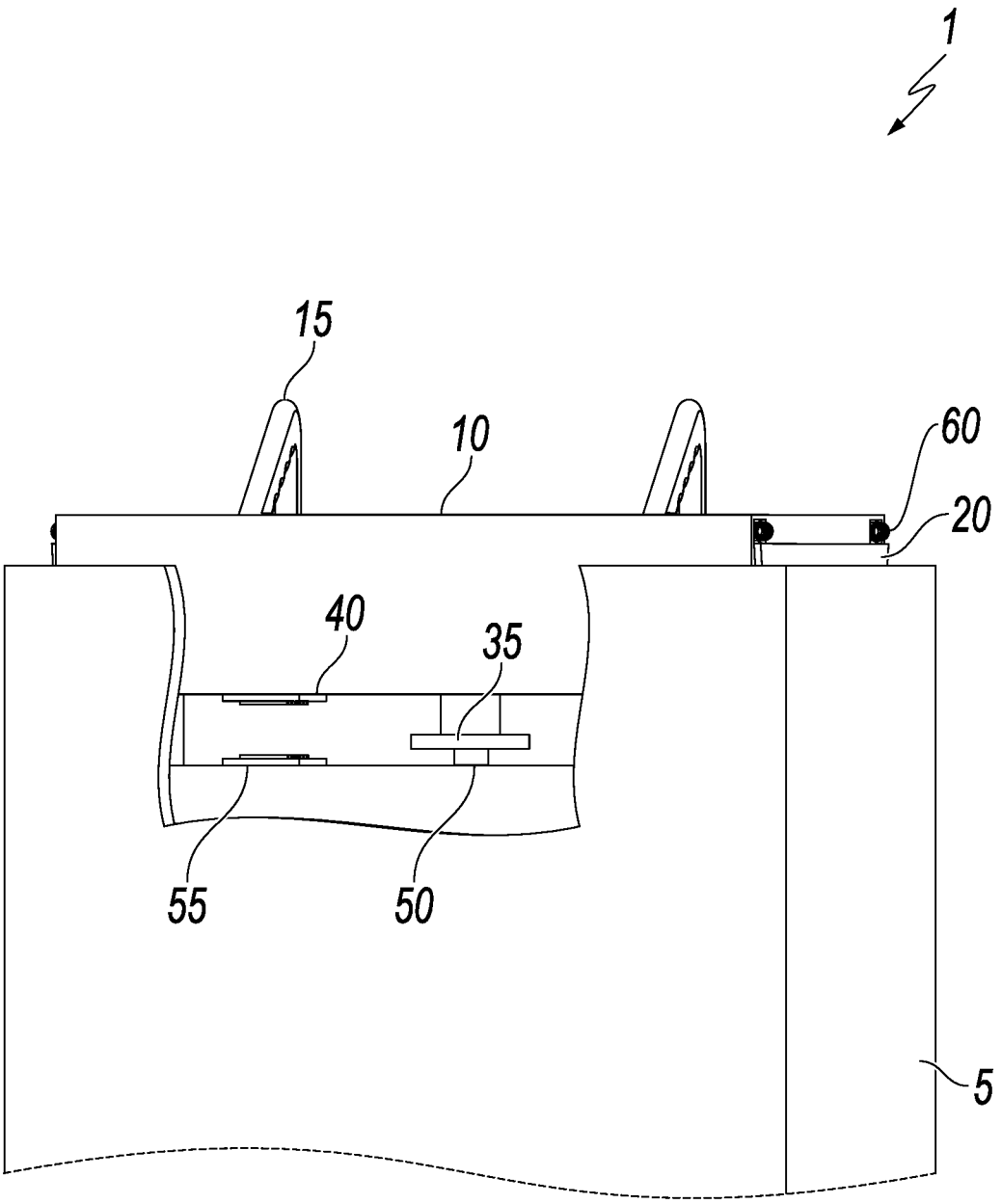
Figure 9:
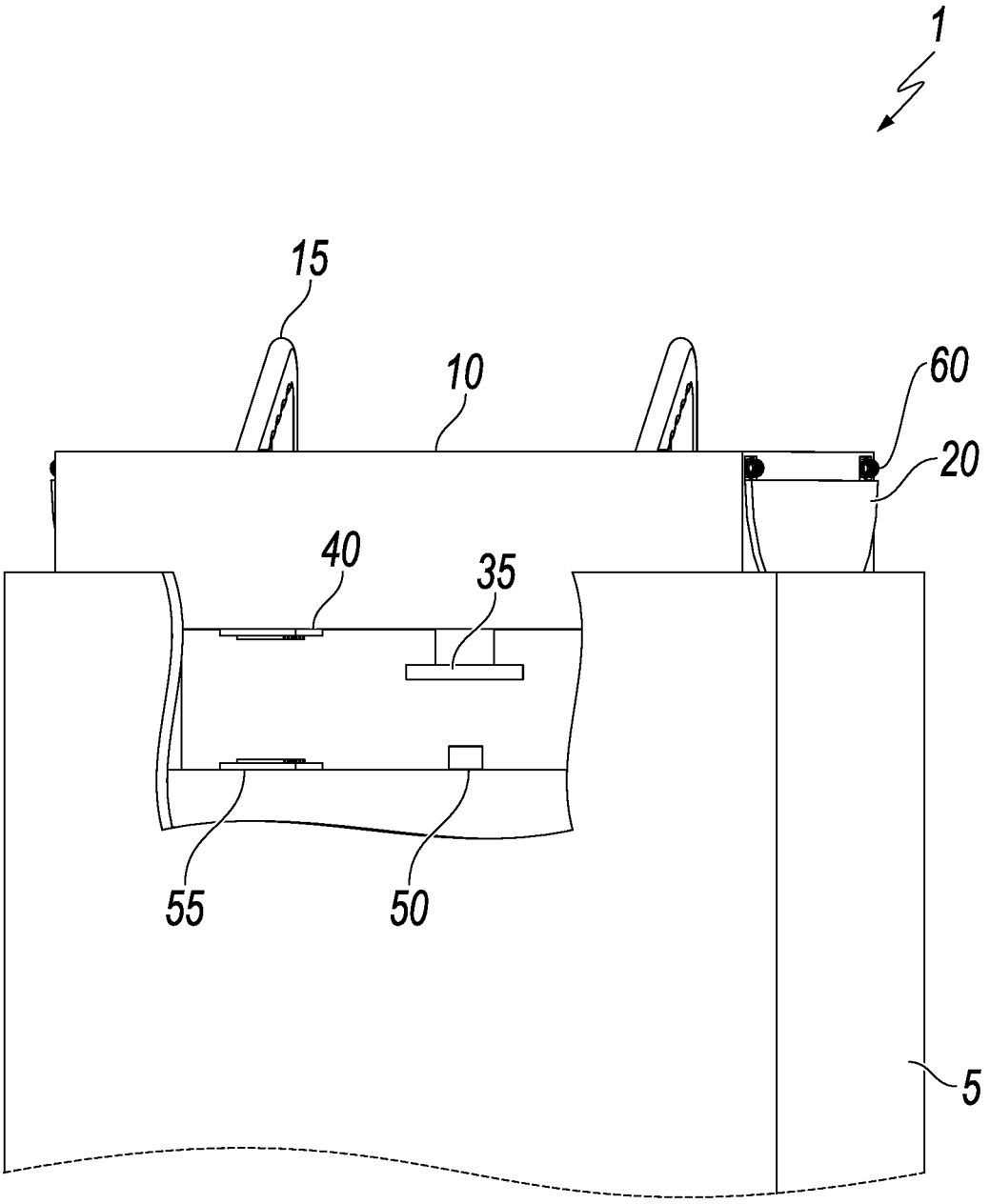
Figure 10:
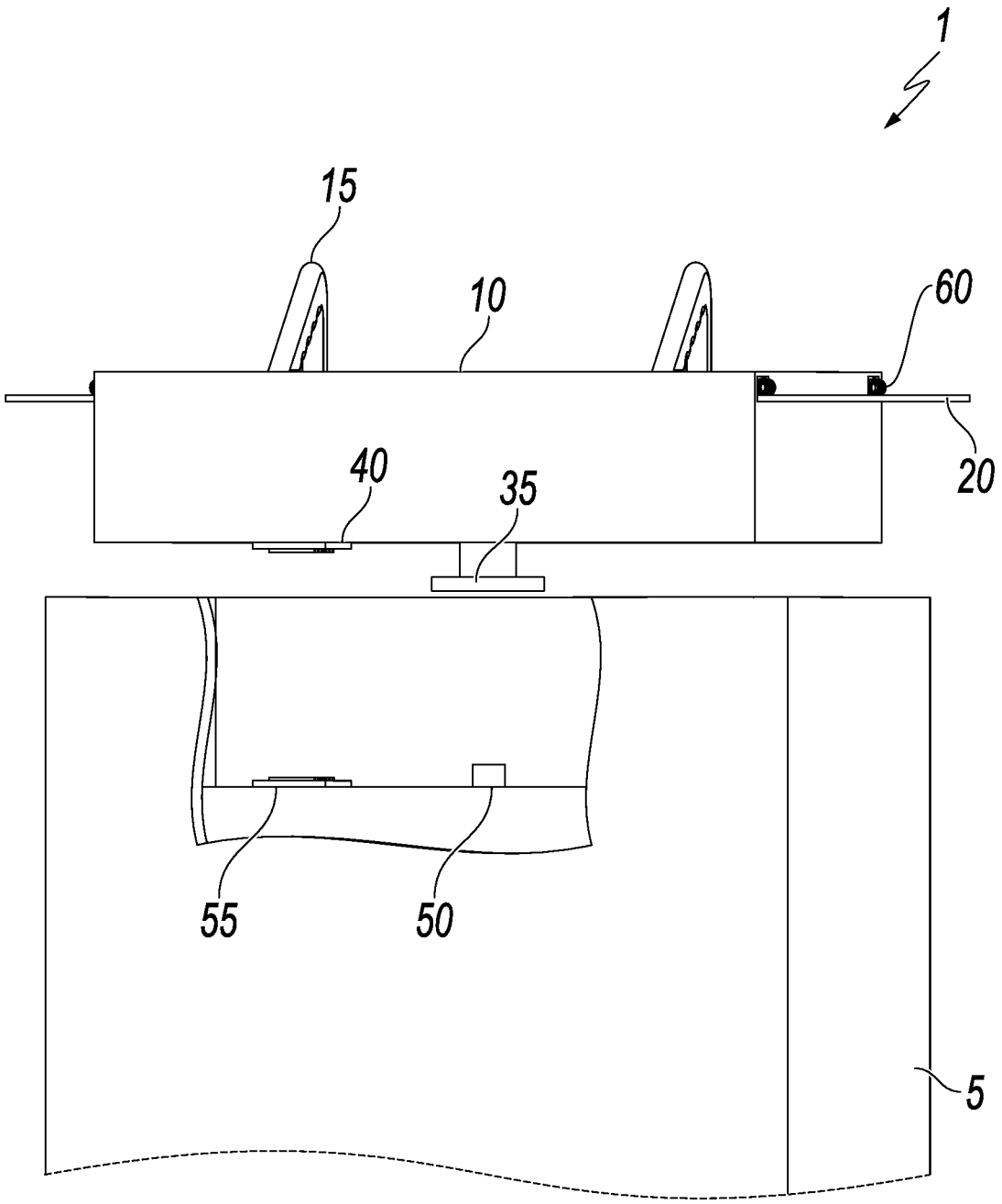

FIG. 4 shows a top rear perspective view of the main unit completely separated from the docking station. The rigid knob 50 is now released. Please note also main unit charging port 55. FIG. 5 is a top rear perspective view of the apparatus. FIGS. 6-10 show, step by step, how the knob 35 mates with, and slowly releases, alarm button 50. Even though the charging port aligns with the vent, those elements do not interact with each other. FIG. 10 further shows side edges of the docking station retaining the shields 20. At this point, the main unit is pulled far enough out of the docking station to spring the shields into position.

Docking station 5 comprises a hollow prism about three feet tall. As with the main unit, other three-dimensional shapes and sizes are permissible and still fall within the scope of this invention. For simplicity and clarity, we illustrate A top face of the docking station is depressed or countersunk about 4 inches deep to allow the main unit to nest therein, flush with the top edge of the docking station. The docking station is preferably made of wood or aluminum.

Figure 11:
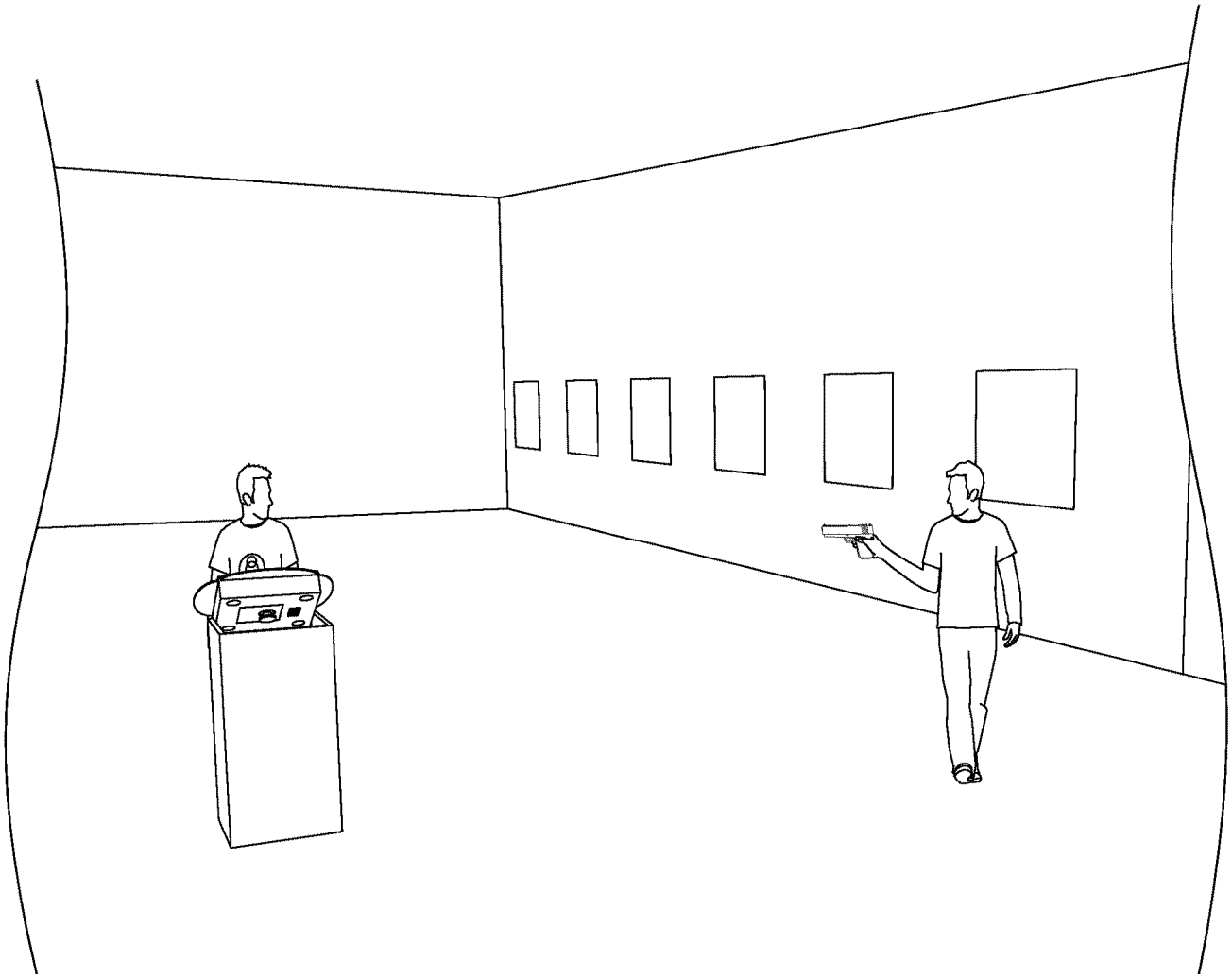
FIG. 11-12 show a person using the apparatus to incapacitate an active shooter.
Figure 12:
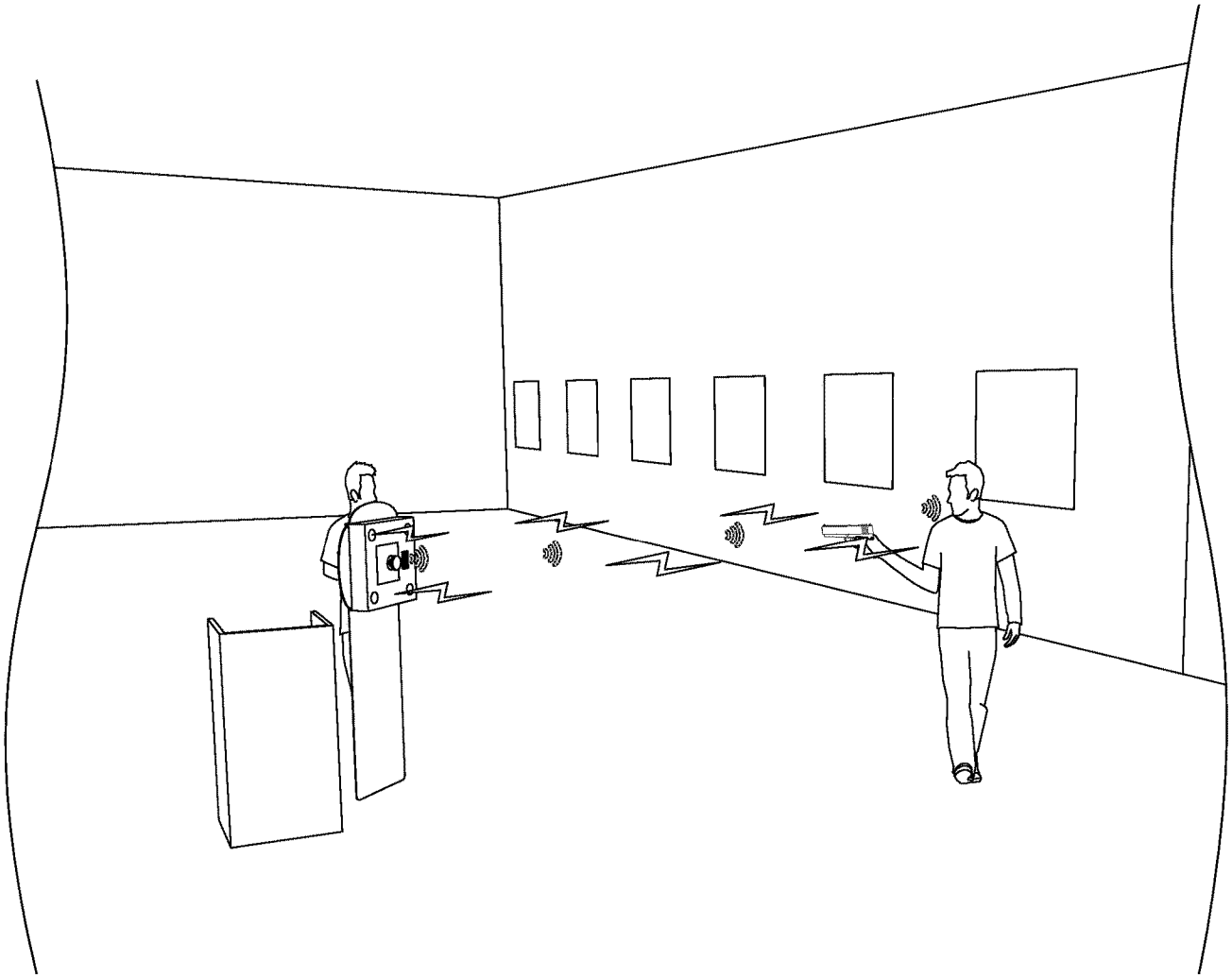

FIG. 11-12 show a user picking up the apparatus from the docking station and aiming it at an active shooter. The user grabs the main unit by the two handles and presses both triggers. The main unit simultaneously fires blinding light, depicted as lightning bolts, deafening sound (depicted as waves) and disabling chemical irritant at the shooter.

Although embodiments and examples of the invention have been shown and described, it is to be understood that various modifications, substitutions, and rearrangements of parts, components, and/or process (method) steps, as well as other uses, shapes, construction, and design of this apparatus for incapacitating an active shooter can be made by those skilled in the art without departing from the novel spirit and scope of this invention.

I claim:

1. An apparatus for incapacitating an active shooter, comprising:

a. a hollow and rigid main unit comprising a front face, this front face having a vent, an opposing back face, a right face, an opposing left face, a top face and an opposing bottom face;

b. a pair of spaced-apart handles fixed to the back face, each such handle having a trigger;

c. a rigid bullet-resistant shield hingedly fixed to each of the right face, the left face and the top face;

d. a plurality of spaced apart arrays of laser light embedded in the front face, each such array resting on an oscillating base and producing a collective 200-1500 lumens of light when a trigger is pressed;

e. means embedded in the main unit for oscillating, when a trigger is pressed, each array of laser light to converge upon a single point in front of a user operating the apparatus;

f. means embedded in the main unit for projecting sound waves through the front face, these sound waves having a frequency between 3-25 kHz and having power between 80-190 dB, when a trigger is pressed;

g. means embedded in the main unit for propelling a chemical irritant through the vent when a trigger is pressed;

h. a bullet-resistant apron fixed to the top face, toward and over the back face and extending beyond the back face;

i. a rigid knob projecting from the front face;

j. a docking station dimensioned to securely receive and mate with the front face of the main unit, this docking station further comprising:

i. a main unit charging port;

ii. a spring-loaded alarm button compressed by the rigid knob while the main unit is nested in the docking station, and released when the main unit is separated from the docking station; and iii. means for alerting local law enforcement when the spring-loaded alarm button is released; and k. means for deploying the bullet-resistant shields when the main unit is separated from the docking station.

2. The apparatus of claim 1, wherein the chemical irritant is a capsaicinoid.

3. The apparatus of claim 2, wherein the capsaicinoid is 1-2% capsaicin.

4. The apparatus of claim 1, wherein the sound waves produce power from 135-160 dB.

5. The apparatus of claim 1, wherein the top face, the back face, the right face, the left face, the top face and the bottom face are made from material selected from the group consisting of aluminum and steel.

6. The apparatus of claim 1, wherein the docking station is made of material selected from the group consisting of aluminum and steel.

7. The apparatus of claim 1, wherein each rigid bullet-resistant shield is made from material selected from the group consisting of aluminum, glass and plastic.

8. The apparatus of claim 1, wherein the bullet-resistant apron is Kevlar®.

9. The apparatus of claim 1, wherein the means for deploying the bullet-resistant shields is a spring.

10. The apparatus of claim 1, wherein the means for propelling the chemical irritant is an aerosol canister.

11. The apparatus of claim 1, wherein the means for projecting sound waves is selected from the group consisting of speakers, woofers and piezoelectric transducers.

12. The apparatus of claim 1, wherein the apron further comprises a pair of spaced-apart holes positioned to allow the apron to lie flat against the hack face.

13. The apparatus of claim 1, wherein the oscillating means is an electric motor connected to each of the bases.

14. The apparatus of claim 1, wherein the main unit is a prism.

* * * * *